US005257945A

United States Patent [19]

Heng et al.

[11] Patent Number: 5,257,945

[45] Date of Patent: Nov. 2, 1993

[54] CONNECTION TERMINAL FOR ELECTRIC WIRES, AND A CONNECTION COMPONENT FOR SUCH A TERMINAL

[75] Inventors: Jean-Paul Heng, Lyon; André Marmonier, Bron; Luc Doutaz, Meyzieu, all of France

[73] Assignee: Entrelec S. A., Villeurbanne, France

[21] Appl. No.: 873,202

[22] Filed: Apr. 24, 1992

[30] Foreign Application Priority Data

Apr. 26, 1991 [FR] France ..... 91 05190

[51] Int. Cl.[5] ..... H01R 4/24

[52] U.S. Cl. ..... 439/406

[58] Field of Search ..... 439/389–425

[56] References Cited

U.S. PATENT DOCUMENTS

| | | | |
|---|---|---|---|
| 3,854,114 | 12/1974 | Kloth et al. | 439/395 |
| 4,125,311 | 11/1978 | Hoppe, Jr. | 439/406 |
| 4,153,324 | 5/1979 | Kukla | 439/406 |
| 4,344,665 | 8/1982 | Racilla et al. . | |
| 4,940,425 | 7/1990 | Hass et al. | 439/406 |

FOREIGN PATENT DOCUMENTS

| | | |
|---|---|---|
| 0222256 | 5/1987 | European Pat. Off. . |
| 0333395 | 9/1989 | European Pat. Off. . |
| WO9005392 | 5/1990 | PCT Int'l Appl. . |
| WO860552 | 11/1986 | World Int. Prop. O. . |

*Primary Examiner*—Joseph H. McGlynn

*Attorney, Agent, or Firm*—Sughrue, Mion, Zinn Macpeak & Seas

[57] ABSTRACT

A terminal includes a metal component held in a housing in the form of at least one connection unit having the general plan appearance of a hollow, convex hexagon split on a longitudinal plane about which it is symmetrical for the purpose of connecting a single electric wire via two parallel stripping and retaining slits. Each unit includes two support sides which project in parallel from a fixed base and each of which carries two other sides of the hexagon shaped unit. Each slit is formed between two sides that are symmetrical. The two support sides press against different mutually parallel walls of the housing via respective symmetrically disposed projections.

7 Claims, 3 Drawing Sheets

100
102
8
12
6
6B
18
5
10
17
5B
6A
5
11
7
5A
4
3
19
9
1
3
1A
2

100
5B
5
18
17
102
11
9
5A
29
19
2

20
21
5A
22
23
102'
11A
9A 13
14
102
15
100
5
11
8
18
12
1
5A
6A
9
7
17
10
1A
16

CONNECTION TERMINAL FOR ELECTRIC WIRES, AND A CONNECTION COMPONENT FOR SUCH A TERMINAL

The invention relates to connection terminals for electric wires and to a connection component for such terminals.

BACKGROUND OF THE INVENTION

There exist numerous connection terminals for electric wires that are of the type having a slit for stripping and retaining the wire, with such terminals being used, in particular, for connecting together or for connecting to equipment, electric wires for distributing power or for transmitting low current signals.

For example, such connection terminals may be of the junction block type, being designed to interconnect electric wires, e.g. in a distribution structure.

Such terminals may also be of the connector type enabling either some number of wires, e.g. from a multiconductor cable, to be connected to equipment including the connector, or else enabling some number of wires in one cable to be connected to wires in another cable, in series or in parallel.

In each case, at least one connection component includes a slit for stripping and retaining a wire, which slit is generally rectilinear, opening out at one end in a flared opening with sharp edges and extending beyond the opening in the form of a zone where the edges of the slit are at least approximately parallel.

A wire to be connected to such a component must be presented transversely relative to the slit so as to bear against the cutting edges of the wire-stripping opening, conventionally via the insulating sheath which covers the outside of the wire.

A pusher is generally provided for making the connection, with the pusher serving to thrust the core of the wire into the wire-retaining zone of the slit where the edges of said slit are at least approximately parallel, after having partially stripped the core of the wire during an initial engagement stage where the wire covering is in contact with the cutting edges of the flared opening that center the wire while simultaneously cutting through the covering in those regions of the covering that bear against the sharp edges.

The pusher is sometimes incorporated in the terminal and constitutes a portion thereof, but it is also possible for the pusher to be carried by an external hand-held tool, as disclosed, in particular, by European patent application No. 2 065 321, or else for the pusher to be mounted on a machine.

In conventional manner, the characteristics defining a connection component having a wire-stripping and wire-retaining slit depend to a large extent on the characteristics of the wire to be connected, and in particular on its section, particularly with respect to the size of the opening and of the gap between the edges of the slit in its wire-retaining zone where said edges are at least approximately parallel.

The dimensioning of the opening has an effect on the quality of the wire stripping in the region of the wire which is held in the wire-retaining zone of the slit, and consequently on the existence or otherwise of electrical contact between the core of the wire and the component in which it is held, and also on whether the core remains in one piece where it is held after it has been stripped.

Similarly, the gap between the edges of the slit must be designed to ensure that the core of the connected wire is held with sufficient force firstly to prevent the wire moving in the wire-retaining zone of the slit, and a fortiori preventing it from leaving said zone, while also preventing the wire-holding edges of the slit from cutting through the core, and secondly for ensuring sufficient contact pressure for electrical purposes under the conditions of use specified by the manufacturer.

As a result, many connection components having a slit for retaining and stripping a wire are made of a metal that is not very resilient so as to ensure that they are very rigid, and as a result they are suitable only for wires whose sections are very similar, e.g. one connector component may be suitable for wires of section 0.22 $m^2$ to 0.34 $mm^2$.

The manufacturers of connector components must therefore provide an entire series of components of different sizes to cover the range of wires that may be connected in this way, thus presenting several significant drawbacks, particularly with respect to manufacturing and costs.

SUMMARY OF THE INVENTION

The present invention thus provides a connection terminal for at least one electric wire, the terminal incorporating a metal connection component held in a housing and organized to form at least one connection unit of convex hexagonal appearance that is slit along one of its diagonal planes about which it is symmetrical for the purpose of connecting a single electric wire via two wire-stripping and wire-retaining slits that lie in the diagonal plane of symmetry of the unit. The unit includes two essentially plane support sides which are disposed parallel to the diagonal plane of symmetry of the unit, projecting from a stationary common base and each carrying two other sides of the hexagon sloping at the ends thereof. Each slit is disposed between two symmetrical sides on the diagonal plane and carried by two different support sides, and is provided with a flared opening having sharp edges for the purpose of stripping a wire, and with the two openings of a unit being situated at opposite ends of the unit relative to the base thereof.

According to a characteristic of the invention, the unit is also symmetrical about a transverse midplane perpendicular to the longitudinal plane of symmetry and common to its two support sides, which support sides bearing against respective ones of two parallel walls of the housing via symmetrical projections disposed in the common transverse midplane of symmetry.

The invention also provides a connection component as outlined with reference to the above-defined terminal, the component comprising at least one connection unit whose parallel support sides include outwardly-extending middle projections for pressing said support sides against the parallel walls of the housing which encloses them, at least in the proximity of the end of said unit that is furthest from its base.

BRIEF DESCRIPTION OF THE DRAWINGS

Embodiments of the invention are described by way of example with reference to the accompanying drawings, in which.

DETAILED DESCRIPTION

Figure 1:
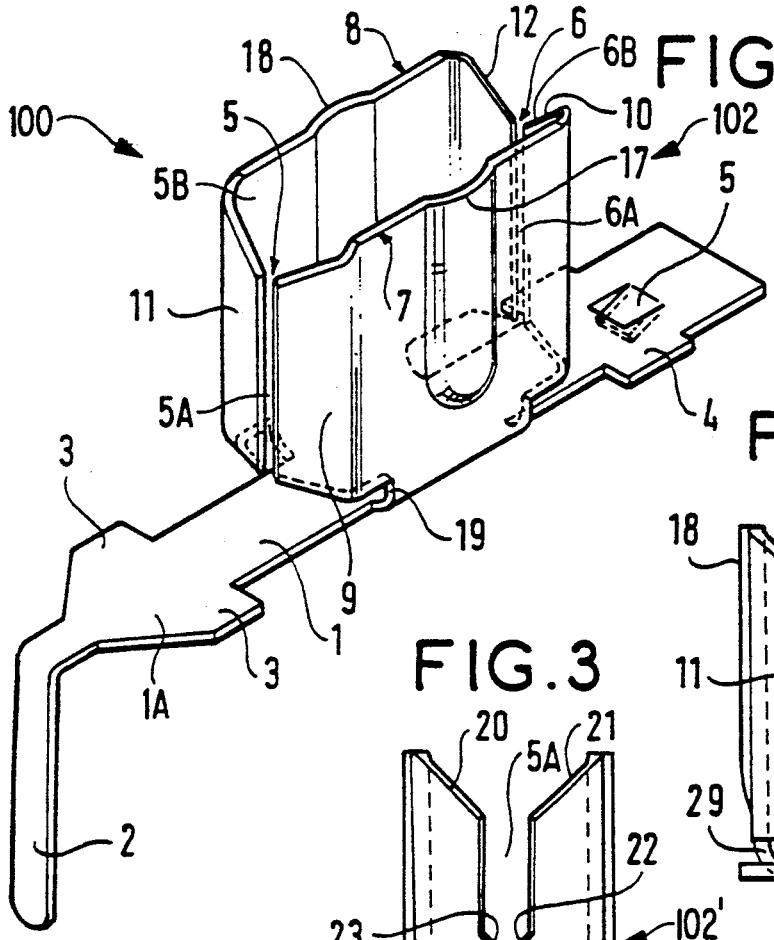
FIGS. 1 and 2 show one example of a connection component of the invention, respectively in an isometric perspective view and as seen from the left end.
Figure 2:
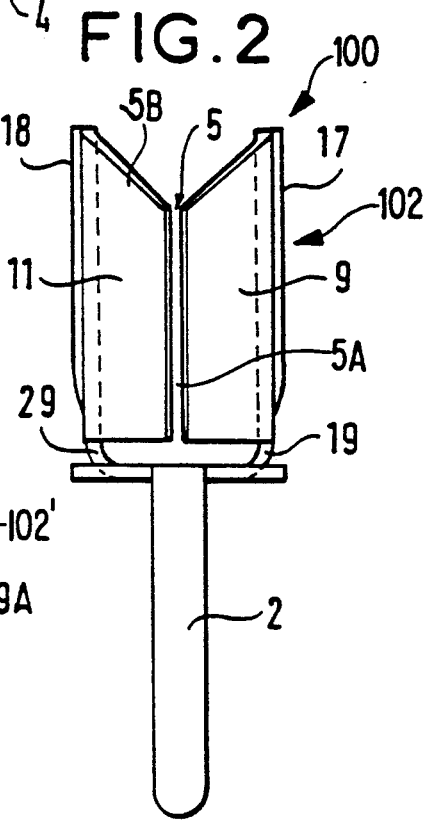

The example connection component shown in FIGS. 1 and 2 comprises a connection unit 100 for making a connection with an electric wire whose core is covered by an insulating sheath.

This component is intended to hold the wire in position and to make electrical contact with its core after stripping the core of its sheath where contact is made.

Numerous connection components of this type are known and are used in various terminals such as those outlined briefly in the introduction to the present application.

The connection component shown herein is assumed to be made by cutting out and folding a plane metal blank using techniques that are well known in the connector field.

The component comprises an element designed to act as a base via which the component stands on the bottom of a housing provided therefor of insulating material and not shown in presently-described FIGS. 1 and 2.

In the example shown, the base referenced 1 is constituted by a blade 1A having one end 2 bent through a right angle, e.g. to form a connection pin designed to project through the wall forming the bottom of the housing in which the component is disposed. Projections 3, 4, and 5 obtained by cutting out are also shown, which projections are designed, for example, to participate in conventional manner in holding the component via its base on the bottom of the housing provided for the component in a box, by co-operating with projections of said box (not shown since this is commonplace in the field and not characteristics of the invention).

A single slitted connection unit 102 for a wire is shown as being carried by the base 1, it being understood that a plurality of units 102 or this type could by carried by the same base 1, should that be required.

The appearance of the connection unit 102 shown herein is that of a hollow, convex hexagon in plan view, with the unit being slit along a longitudinal center plane thereof about which it is symmetrical, said plane not being shown specifically in FIGS. 1 and 2 in order to keep the drawings simple.

A wire is connected by means of two slits 5 and 6, at opposite ends for retaining the wire and for stripping it, which slits are parallel and lie in the longitudinal plane of symmetry of the split connection unit 102, being located at opposite ends of said longitudinal plane.

The connection unit 102 shown has two, opposite support sides 7 and 8 which are essentially plane in the present case and which project from the base 1 parallel to the longitudinal plane of symmetry of the component 100 and on opposite sides thereof, so as to be symmetrical thereabout, the component 100 that includes said support sides being itself symmetrical about said plane, as mentioned above.

At its end, each support side 7 and 8 carries two respective other sides 9 and 10 or 11 and 12 that slope relative thereto obliquely away from each other, with the six sides 7 to 12 defining the hollow convex hexagonal shape of the connection unit under consideration.

Each of the slits 5 and 6 is provided between two of the sides carried by two different support sides 7 and 8, i.e. between the sides 9 and 11 or between the sides 10 and 12, with the two sides on either side of a slit being disposed symmetrically about the longitudinal plane of symmetry of the component 100.

Each slit 5 and 6 includes a wire-retaining one, 5A, 6A where the edges of the sides that delimit the slit are at least approximately parallel, and a flared wire-stripping opening 5B, 6B which is situated at a distance from the base 1 relative to the remainder of the unit and which is formed by tapering edges which are sharpened in this region, e.g. by being chamfered.

Figure 4:
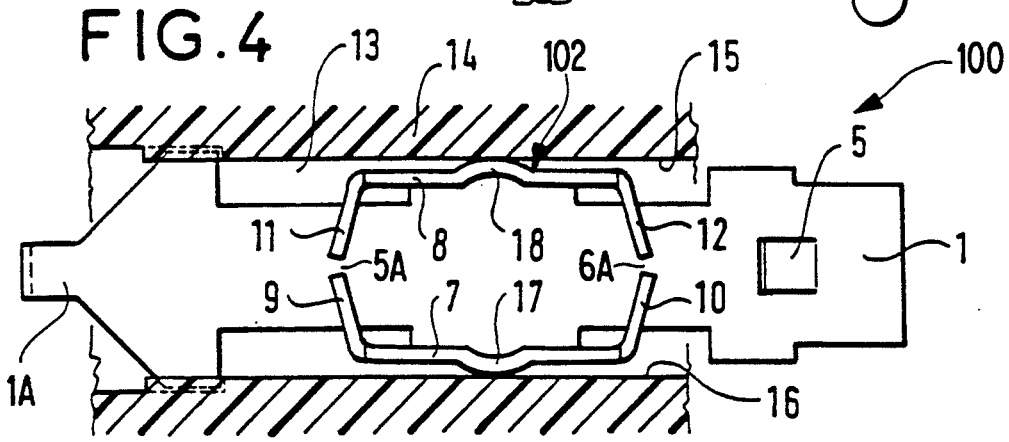
FIGS. 4 and 6 show one way in which a connection component may be installed in a terminal of the invention, respectively as seen from above and as seen from its lefthand end.
Figure 6:
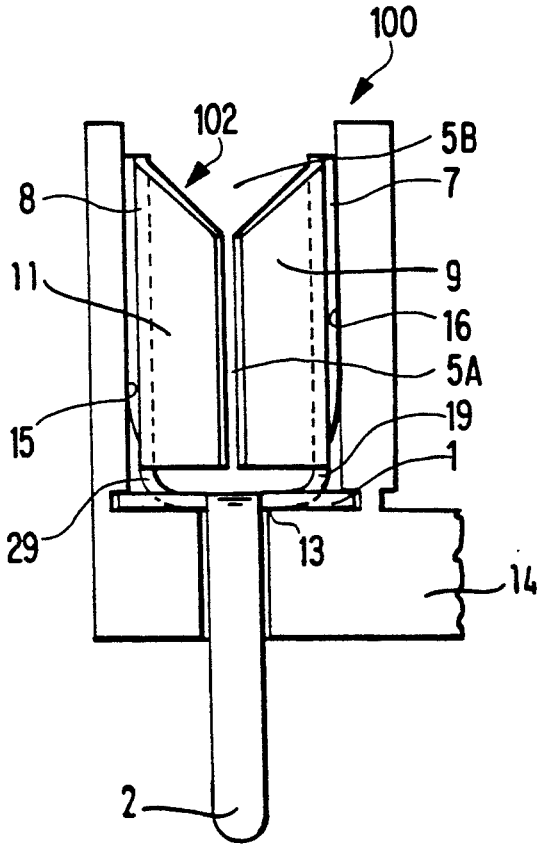

The connection unit made in this way is secured, generally via its base 1, to the bottom 13 of a housing 14 containing it, with the support sides 7 and 8 being substantially parallel to the two parallel walls 15 and 16 of the housing 14 and either pressing outwardly thereagainst as can be seen in FIGS. 4 and 6, or else being disposed at a very short distance therefrom.

In the embodiment shown in FIGS. 1 to 4, each of the support sides 7 and 8 bears against the adjacent wall 15 or 16 of the housing FIG. 4, by means of a respective projection 17 or 18 formed symmetrically on either side of the longitudinal plane of symmetry of the unit and also about a transverse midplane of said component that extends perpendicularly to the longitudinal plane of symmetry of the component and in this case also to the base of said component.

In the embodiment shown in FIGS. 1 to 4, there is a single one of these projections 17, 18 respectively on the support sides 7, 8 and each runs towards the base 1 from the edge of the support side furthest from the base over a distance which, in the example shown, is less than the distance between said edge and the base.

Each of the support sides 7 and 8 is preferably connected to the base 1 from which it projects via a curved zone such as 19 or 29 (FIG. 1) that is shorter than the corresponding support side 7, 8, with the two other sides of the hexagon, such as 9 and 10, carried by a support side such as 7, being free of base 1 beginning on the support side beyond said curved zone where it is connected to the base.

In conventional manner, in particular as disclosed in document EP-A-0 265 321 for a similar terminal, a wire is connected to such a component by placing the wire in the longitudinal horizontal plane of symmetry of the component 100 so that the wire is engaged simultaneously in both of the wire-stripping opening 5B, 6B, after which the wire is thrust by means of an appropriate tool into the two wire retaining zone slits 5A, 6A of the component, with the tool moving along the slits towards the base while the wire is being pushed.

When the core of the wire is inserted into the wire-retaining zone of a slit in a connection unit 102, it tends to push or flex apart the edges delimiting said slit, thereby ensuring that the core is held by the slit.

To ensure that the wire is held satisfactorily, the connection unit is generally designed to be very stiff and it is commonly reinforced by the support sides 7 and 8 pressing against rigid or stiffened walls 15 and 16 of the housing for the component, i.e. by the projections 17 and 18.

Under normal conditions of use, the connection unit presses via these projections 17 and 18 against the walls 15 and 16 of the housing in which it is situated when a wire of appropriate section is inserted in its slits, and into the respective wire-retention zones thereof.

This makes it possible to obtain the required pressure conditions on the edges contacting opposite sides of the wire in each slit, with the gap between the walls 9, 11 and 10, 12 being defined at the design stage of the terminal so that the connection unit 102 operates under specified conditions for a given wire, with the projections 17, 18 being required to bear against the walls 15, 16 in order to retain the wire in the slits.

Consequently, the range of wires that can be connected to a given connection unit installed between housing walls 15, 16 that are at a determined distance apart is very restricted, as is conventional in this field.

In contrast, by having curved zones such as 19 and 29 between the base 1 of the unit and the two support sides 7 and 8 of the unit, limited bending is made possible, whereby each support side can flex from an initial angular position relative to the base from which it projects towards a slightly different angular position.

As a result, the range of wire sections that can be accepted by a given connection unit of the invention can be increased by taking advantage of the available maximum separation between the support sides of the unit: i.e. by providing housings that are slightly different with respect to their walls 15 and 16, e.g. walls 15 and 16 that are spaced apart by slightly different amounts, optionally in association with slightly different heights and/or angles relative to the base of the housing to which the base of the connection unit is fastened.

The thrust of each support side 7 and 8 via its middle projection 17 or 18 in association with the shortening of the curved junction zones between the support sides and the base makes it possible to increase the amount of flex bending that can be accepted by the connection unit, thereby making it possible for a given connection unit to accept wires over a wider range of sections under mechanical and electrical conditions that are practically identical by providing boxes having housings that are slightly different, said housings having their walls 15 and 16 disposed slightly differently as a function of the selected section or small range of sections.

Figure 3:
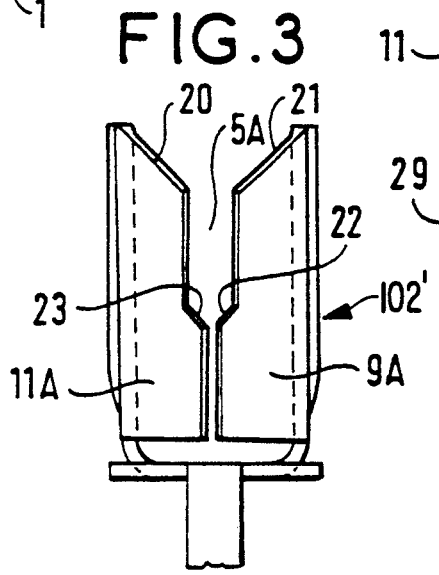
FIG. 3 shows a variant of the connection component of the invention.

It is also possible to increase the range of wire sections that can be accepted by a given connection unit 102' by providing wire-stripping and wire-retaining slits on two levels, as shown in FIG. 3.

The sides such as 9A and 11A between which a slit such as 5A is formed are now shaped so as to include a first flared opening with sharp sloping edges such as 20 and 21 for a first wire section followed by a first retaining zone having edges that are at least approximately parallel.

The end of this first retaining zone that is furthest from the first opening is extended by a second retaining zone where the distance between the at least approximately parallel edges is less than the corresponding distance in the first zone. This second retaining zone is designed for a smaller section wire whose core can slide without damage through the wider first retaining zone.

The junction between the first and second retaining zones takes place via a transition designed to perform or improve stripping of the above-mentioned smaller section wire, said transition being constituted by sharp-edged, sloping edge portions such as 22 and 23.

Figure 5:
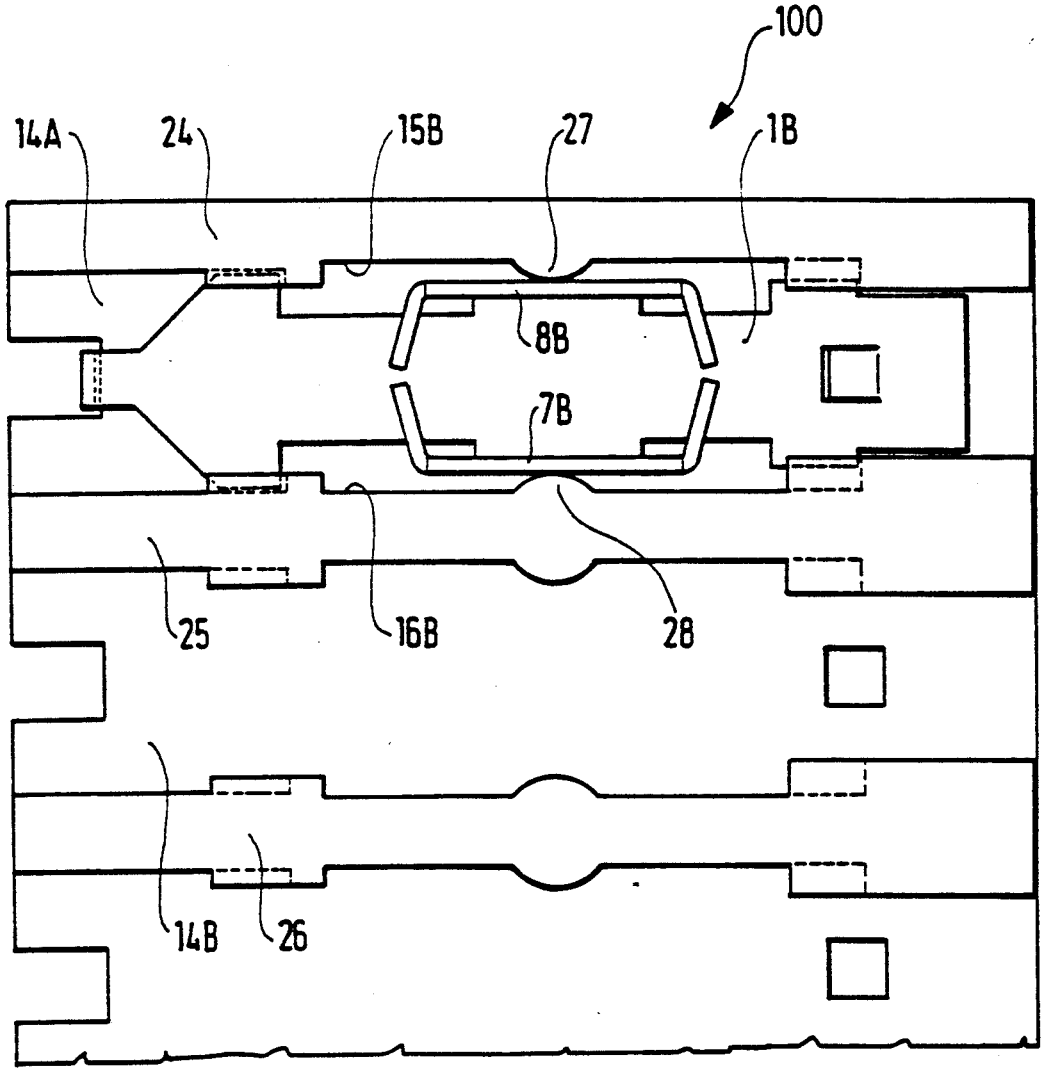
FIG. 5 shows a variant terminal of the invention as seen from above.

Although the thrust projections on the support sides of a connection piece for engaging the parallel walls of the housing in which they are received are suitable for being provided on the sides themselves, it is also possible in a variant to provide these projections in practically the same geographical disposition on the walls, as shown in FIG. 5.

The housing of insulating material is assumed to be designed to contain a plurality of parallel connection components (only one of which is shown) and the housing includes a plurality of parallel housing sections 14A, 14B, separated from one another by laterally spaced parallel, longitudinally extending partitions 24, 25, and 26.

The connection component 100" shown differs from that at 100, shown in FIG 4 by having no projections on its support sides 7B and 8B, each of which bears via a plane wall against a corresponding wall 15B or 16B of the housing for the component.

Projections such as 27 and 28 are provided on the parallel facing walls 15B and 16B of the housing for the component under consideration, and they are disposed to bear against the support sides 7B and 8B of said component under determined conditions, when connected to an appropriate type of wire.

In the embodiment shown, these projections face each other in a position such that they lie in the "middle" transverse plane of symmetry of the connection unit of the invention which is both common to the sides 7B and 8B and perpendicularly to the base 1B of said component 100", and also perpendicular to the diagonal longitudinal plane of symmetry thereof on which the two wire-stripping and wire-retaining slits of the unit are in alignment. As before, a succession of acceptable ranges of wire sizes can be made available using a single design of component providing said component is mounted in boxes provided with housings that are slightly different.

We claim:

1. A connection terminal for at least one electric wire, said terminal including a metal component held in a housing having laterally opposed parallel walls and disposed to form at least one connection unit having a general plan appearance of a hollow, convex hexagon with a longitudinal plane of symmetry, two wire-stripping and wire-retaining slits within said at least one connection unit lying in said longitudinal plane of symmetry of said unit for connection to a single electric wire, said unit including two essentially plane support sides disposed parallel to the longitudinal plane symmetry of the unit and unitary with and projecting from a stationary longitudinal common base, each of said two support sides carrying two other sides of the hexagon shaped unit at opposite ends thereof and free of said base, said other sides sloping oppositely oblique to each other, and each slit being formed between two symmetrical sides about the longitudinal plane of symmetry, carried by two different support sides and being provided with a flared opening with oppositely oblique sharp edges for stripping a wire, remote from the base of said unit, and wherein said unit is also symmetrical about a midplane perpendicular to the longitudinal plane of symmetry and common to said two support sides, and wherein each of said two support sides bear flexibly against a respective one of said parallel walls of the housing via a corresponding symmetrically disposed projection lying on the common midplane of symmetry.

2. A connection terminal according to claim 1, wherein each support side is joined to the common base via a curved zone that is narrower than said support side, thereby firstly enabling an angle between said support side and the base to be varied with limits with an angular separation being fixed for the two support sides by a space between the two parallel walls of the housing lying exterior of said support sides, and secondly enabling each of the slits to be enlarged by flex splaying apart the support sides carrying said other sides defining said slits.

3. A connection terminal according to claim 1, wherein the symmetrical projections are disposed on the exterior of the support sides of the connection unit, at least in portions thereof furthest from the base.

4. A connection terminal according to claim 1, wherein the symmetrical projections are formed on said opposed parallel walls of the housing for said connection unit and which are parallel to the support sides of said connection unit and on respective sides of said unit.

5. A connection component for at least one electric wire to be held in a housing having spaced, opposed parallel walls, comprising: at least one connection unit of a hollow convex hexagon plan form having a longitudinal plane of symmetry for the purpose of connecting a same electric wire and having two stripping and retaining slits that lie in said longitudinal plane of symmetry of the unit to receive said wire, said unit including two essentially plane support sides disposed parallel to the longitudinal plane of symmetry of the unit, projecting from a common fixed base and each support sides carrying two other sides of the hexagon plan form unit at opposite ends of the support sides extending in obliquely opposite directions away from each other, each slit thereby being formed between two other sides disposed symmetrically about the longitudinal plane and carried by two different support sides and being provided with a sharp-edged wire-stripping flared opening situated remote from the base of said unit, said unit being also symmetrical about a transverse midplane perpendicular to the diagonal plane of symmetry and common to said support sides, and each of the two support sides of a unit including outwardly-directed, middle projections whereby the support sides bear flexibly against spaced, opposed parallel walls of the housing, respectively, that lie adjacent to the exterior of said support sides, at least in the vicinity of said unit furthest from said base.

6. A connection component according to claim 5, wherein each support side is integral with the common fixed base via a curved zone that is narrower than the support side, enabling firstly the angle formed between the support side in question and a space in the housing between said walls to be varied, and secondly enabling each of the slits to be enlarged by deforming the support sides.

7. A connection component according to claim 5, wherein each connection unit is a cut and folded plane metal blank.

* * * * *